US009114604B2

(12) United States Patent
LeFevre et al.

(10) Patent No.: US 9,114,604 B2
(45) Date of Patent: Aug. 25, 2015

(54) METHOD AND APPARATUS FOR APPLYING A RELEASE AGENT TO A SUBSTRATE HAVING A PRINT IMAGE

(75) Inventors: Jason LeFevre, Penfield, NY (US); Paul McConville, Webster, NY (US); James Michael Chappell, Webster, NY (US); Jennifer Rea, Rush, NY (US); James Edward Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 584 days.

(21) Appl. No.: 13/517,533

(22) Filed: Jun. 13, 2012

(65) Prior Publication Data

US 2013/0338812 A1 Dec. 19, 2013

(51) Int. Cl.

| | |
|---|---|
| ***B41F 22/00*** | (2006.01) |
| ***B41M 5/00*** | (2006.01) |
| ***B41M 1/06*** | (2006.01) |

(52) U.S. Cl.

CPC ..... *B41F 22/00* (2013.01); *B41M 1/06* (2013.01); *B41M 5/00* (2013.01)

(58) Field of Classification Search

CPC ..... G03G 15/23–15/235; G03G 15/2064; G03G 15/2075; G03G 2215/2093; G03G 2215/2032; G03G 2215/2016; G03G 2215/00801; B41F 22/00; B41J 3/60; B41J 11/0015; B41M 5/0011–5/0017; B41M 1/06; B41M 5/00

USPC ..... 700/117; 118/46, 70, 696, 697; 101/416.1–424.2, 476; 399/320–342

See application file for complete search history.

(56) References Cited

U.S. PATENT DOCUMENTS

| | | | | |
|---|---|---|---|---|
| 5,270,770 | A * | 12/1993 | Kukimoto et al. | 430/123.51 |
| 6,010,791 | A * | 1/2000 | Tan et al. | 428/451 |
| 6,830,643 | B1 * | 12/2004 | Hayes | 156/241 |
| 8,950,855 | B1 * | 2/2015 | LeFevre et al. | 347/101 |
| 2004/0101333 | A1 * | 5/2004 | Wu et al. | 399/325 |
| 2004/0120736 | A1 * | 6/2004 | Kowalski | 399/325 |
| 2005/0135847 | A1 * | 6/2005 | Bogoshian | 399/328 |
| 2007/0020002 | A1 * | 1/2007 | Zess et al. | 399/325 |
| 2010/0053239 | A1 * | 3/2010 | Furukawa | 347/6 |
| 2011/0297996 | A1 * | 12/2011 | van den Brand et al. | 257/99 |
| 2013/0236703 | A1 * | 9/2013 | Sommers | 428/195.1 |
| 2013/0333583 | A1 * | 12/2013 | LeFevre et al. | 101/424.2 |
| 2013/0337151 | A1 * | 12/2013 | Williams et al. | 427/8 |
| 2014/0267482 | A1 * | 9/2014 | LeFevre et al. | 347/14 |
| 2015/0022570 | A1 * | 1/2015 | Chappell et al. | 347/6 |

* cited by examiner

*Primary Examiner* — M. N. Von Buhr

(74) *Attorney, Agent, or Firm* — Ronald E. Prass, Jr.; Prass LLP

(57) ABSTRACT

An approach is provided for applying a release agent to a substrate having at least a first surface and a second surface. The approach involves determining a presence of at least one ink image applied to at least one portion of at least one of the first surface and the second surface of the substrate by way of at least one step of a printing process. The approach also involves causing, at least in part, the release agent to be applied to the substrate so as to cover the at least one portion of at least one of the first surface and the second surface of the substrate upon which the at least one ink image is applied.

30 Claims, 7 Drawing Sheets

METHOD AND APPARATUS FOR APPLYING A RELEASE AGENT TO A SUBSTRATE HAVING A PRINT IMAGE

FIELD OF DISCLOSURE

The disclosure relates to a method and apparatus for applying a release agent useful in printing to a substrate. The release agent is applied to prevent offset of one or more inks related to an image from a substrate to one or more portions of print processing and/or finishing equipment.

BACKGROUND

During a manufacturing process of printed material, ink printed onto a substrate often offsets from the substrate to various parts of printing apparatuses and/or finishing equipment such as, but not limited to, rollers, winders, unwinders, die cutters, buffers, stackers, back sides of rolled and/or stacked printed substrates, etc.

Various conventional printing apparatuses prevent ink offset from a printed substrate to various parts of the printing apparatus within themselves during or before a print process by optimizing a number of different options that include controlling: 1) ink/substrate and/or drum/roller surface temperature, 2) drum/roller surface finish, 3) absence of relative motion between ink/substrate and drum/roller surfaces and 4) application of a release agent.

In conventional printed product manufacturing, a substrate, having been printed, is often made ready for finishing by rolling or stacking the substrate. Some of the release agent applied within a conventional printing apparatus may remain on the substrate after the printing process is complete as a side effect of the printing process. But, there is often not enough release agent remaining on the substrate to prevent ink offset from the printed substrate to various parts of the printing apparatus downstream of the one or more positions within the printing apparatus where the print process occurs, or of finishing equipment positioned downstream of the printing apparatus in the print product manufacturing process.

SUMMARY

Therefore, there is a need for an approach for applying a release agent to a substrate to prevent ink offset from the substrate to one or more portions of print processing and/or finishing equipment.

According to one embodiment, a method for applying a release agent to a substrate having at least a first surface and a second surface comprises determining a presence of at least one ink image applied to at least one portion of at least one of the first surface and the second surface of the substrate by way of at least one step of a printing process. The method also comprises causing, at least in part, the release agent to be applied to the substrate so as to cover the at least one portion of at least one of the first surface and the second surface of the substrate upon which the at least one ink image is applied.

According to another embodiment, an apparatus for applying a release agent to a substrate having at least a first surface and a second surface comprises at least one processor, and at least one memory including computer program code for one or more computer programs, the at least one memory and the computer program code configured to, with the at least one processor, cause, at least in part, the apparatus to determine a presence of at least one ink image applied to at least one portion of at least one of the first surface and the second surface of the substrate by way of at least one step of a printing process. The apparatus is also caused to cause, at least in part, the release agent to be applied to the substrate so as to cover the at least one portion of at least one of the first surface and the second surface of the substrate upon which the at least one ink image is applied.

According to another embodiment, a computer-readable storage medium carrying one or more sequences of one or more instructions which, when executed by one or more processors, cause an apparatus to determine a presence of at least one ink image applied to at least one portion of at least one of the first surface and the second surface of the substrate by way of at least one step of a printing process. The apparatus is also caused to cause, at least in part, the release agent to be applied to the substrate so as to cover the at least one portion of at least one of the first surface and the second surface of the substrate upon which the at least one ink image is applied.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Figure 1:
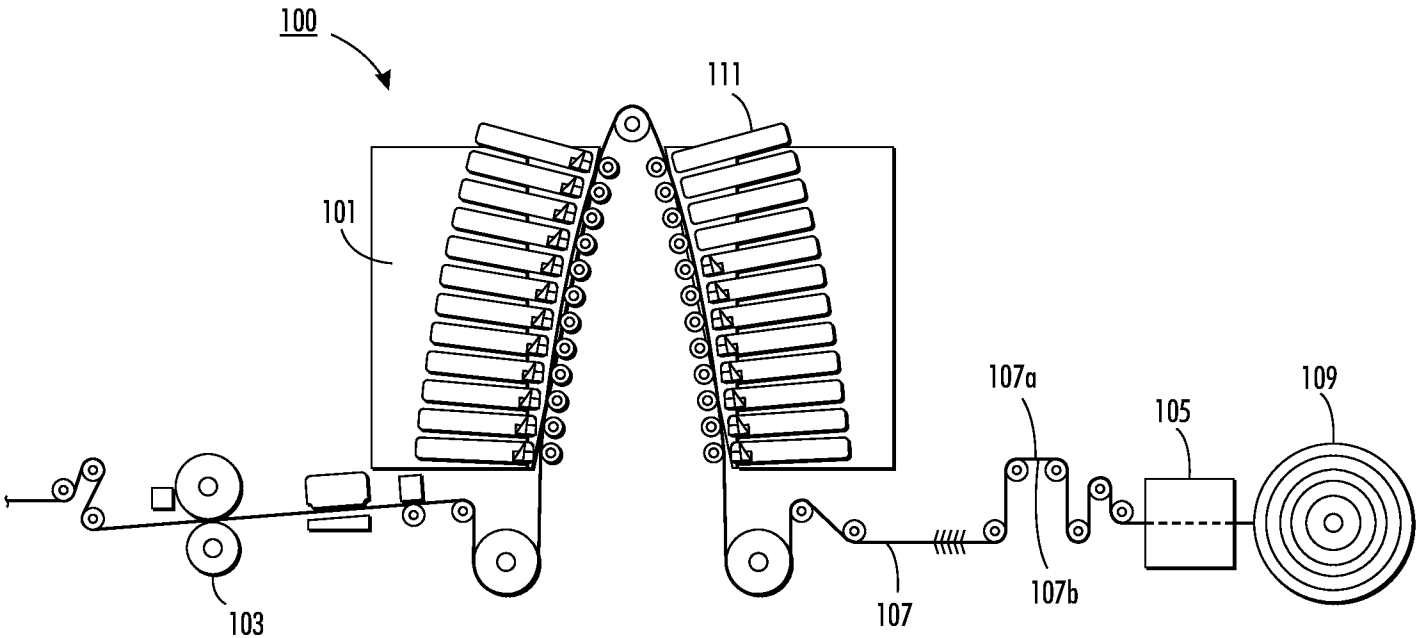
FIG. 1 is a diagram of a system capable of applying a release agent to a substrate to prevent ink offset from the substrate to one or more portions of print processing and/or finishing equipment, according to one embodiment.

Examples of a method, apparatus, and computer program for applying a release agent to a substrate to prevent ink offset from the substrate to one or more portions of print processing and/or finishing equipment are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures devices are shown in block diagram form in order to avoid unnecessarily obscuring the embodiments.

As used herein, the term release agent refers to any type of oil, silicone-based product, silicone mix product, water mixture, water, liquid, powder, etc. that may be applied to a printed substrate to prevent ink offset from the substrate to any printing and/or finishing equipment. For example, a type of oil that can be used to achieve the desired results in preventing ink offset may be Silicon based oils blended w/small amounts of amine (e.g. 0.5% amine), or oils described as a polydimethylsiloxane+polydimethylsiloxane with aminoalkyl groups and has a kinematic viscosity in the 50 cS to 100 cS range. More specifically, the kinematic viscosity may be in a range of 70 cS to 80 cS.

During a manufacturing process of printed material, ink printed onto a substrate often offsets from the substrate to various parts of printing apparatuses and/or finishing equipment such as, but not limited to, rollers, winders, unwinders, die cutters, buffers, stackers, back sides of rolled and/or stacked printed substrates, etc.

Various conventional printing apparatuses prevent ink offset from a printed substrate to various parts of the printing apparatus within themselves during or after a printing process by optimizing a number of different options that include controlling: 1) ink/substrate and/or drum/roller surface temperature, 2) drum/roller surface finish, 3) absence of relative motion between ink/substrate and drum/roller surfaces and 4) application of a release agent.

In conventional printed product manufacturing, a substrate, having been printed, is often made ready for finishing by rolling or stacking the substrate. Some residual of the release agent applied within a conventional printing apparatus may remain on the substrate after the printing process is complete as a side effect of the printing process. But, there is often not enough release agent remaining on the substrate to prevent ink offset from the printed substrate to various parts of the printing apparatus downstream of the printing process and/or finishing equipment.

A large portion of the printing industry (about 80% of the continuous feed industry, for example) prints product onto a substrate roll-to-roll on the printing apparatus. That is, the substrate starts as a roll of, for example, paper, plastic, metal, carbon fiber, etc., whether initially printed or blank, the roll as it is fed into a print engine, and re-wound at the end of a print process conducted by the print engine. The roll is then often transferred at some later point in time to off-line finishing equipment. Some print engines, as discussed above, may be configured to apply a release agent to the substrate as it is printed to prevent ink offset to parts of the print engine. During a printing process, some of this release agent remains on the substrate as it is wound as a side effect. This remaining release agent sometimes protects printing apparatus parts and/or off-line finishing equipment from ink offset, but, there is often not enough release agent remaining on the substrate to prevent downstream ink offset.

For example, in the case of off-line finishing, when the substrate is wound up on a large roll, the residual release agent applied to the substrate by the print engine is allowed to migrate from the top surface of the substrate on either side into the center of the thickness of the substrate and/or disperse by other means such as if the roll is stood up on its side for storage the release agent may migrate to a bottom side that the roll rests upon in storage, etc. This may happen instantaneously, or after a roll is allowed to sit for some time before being processed downstream of the print engine by any finishing equipment. A similar issue of migration often arises if the substrate is sheeted and stacked rather than rolled. It is this migration that is problematic for off-line finishing, even if an appropriate amount of residual release agent remains on the substrate after printing because it reduces the effectiveness of the "protective barrier" of the residual release agent and compromises the resistance to ink offset in the finishing equipment.

Conventional off-line finishing equipment often do not have release agent application devices like some print engines and are often made by different manufacturers, and/or separately located from a print engine, and/or separately controlled. As such, it is difficult to control the 1) ink/substrate and/or drum/roller surface temperature, 2) drum/roller surface finish, and 3) absence of relative motion between ink/substrate and drum/roller surfaces in the finishing equipment to help prevent ink offset like in a print engine. Also, some print engines may not have such controllable features, or even be configured to apply a release agent to printed substrates to even result in the residual release agent being present on the substrate.

To address this problem, a system 100 of FIG. 1 introduces the capability to apply a release agent to a substrate to prevent ink offset from the substrate to one or more portions of print processing and/or finishing equipment. As shown in FIG. 1, the system 100 comprises a print system 101, a print system release agent spreader module 103 and a release agent application apparatus 105 configured to treat a substrate 107 with a release agent at least prior to entering any finishing equipment.

In this embodiment, the release agent application apparatus 105 is positioned at a location before the substrate 107 is wound onto a roll 109 and downstream of any printing process that the print system 101 may perform to apply an ink to form an image onto the substrate 107. For example, the print system 101 may apply an image to the substrate 107 by way of any means such as offset printing or inkjet printing, for example, using print stations 111. According to various embodiments, one or more release agent application apparatuses 105 may be positioned internal to the print system 101 to apply release agent to the substrate 107 at any point after a printing process performed by the print system 101. For example, a release agent application apparatus 105 may be positioned to apply a release agent between color applications and/or between various stages of applying ink to form an image on the substrate 107 if, for example, the print system 101 has more than one print station 111.

In the example illustrated in FIG. 1, the release agent application apparatus 105 adds additional release agent to any release agent that may be applied by the print system release agent spreader module 103, or applies release agent to the substrate 107 for the first time if the print system 101 either did not apply a release agent, or is not configured to apply a release agent at a position downstream of any printing process performed by the print system 101 before the substrate is wound to create roll 109. In alternative embodiments, the substrate 107 may be provided to the print system 101 as pre-cut sheets rather than as a roll which would result in the sheeted substrate being stacked at a backend of the print system 101 rather than being wound. Or, in another embodiment, the print system 101 may be configured to receive a rolled substrate and cut the substrate 107 into sheets for stacking after completion of a printing process performed by the print system 101 to apply an image to the substrate.

As discussed above, one problem with rolling or stacking printed substrate relates to the state of the printed substrate as it enters off-line finishing equipment after some period of time that the printed roll has sat idle following the printing process on the print system 101. In the case of an in-line finishing operation the print system residual release agent acts as a protective barrier, if enough remains on the substrate 107, to prevent ink offset within the printing system 101 but also when that same image enters finishing equipment if sufficient residual release agent remains on the substrate after the printing process is complete.

But, an amount of the residual release agent present on the substrate 107 is often not reliable and ink offset still occurs. Accordingly, at least the release agent application apparatus 105 is positioned after the entire print process is complete as an example and before the substrate is prepared for finishing by way of forming the roll 109, or stacking sheets if the substrate is sheeted, for example. In other embodiments that will be discussed in more detail below, one or more release agent application apparatuses 105 may also be positioned on or between any piece of finishing equipment that may be retrofitted with the release agent application apparatus 105.

Accordingly, any release agent application apparatus 105 controls the state of the substrate going into the printing and/or finishing equipment (or process) that it may be positioned before in the print product manufacturing process by applying a release agent to a printed substrate to protect the printing and/or finishing equipment from ink offset. According to various embodiments, the release agent application apparatus 105 may be positioned to protect nearly any configuration of finishing equipment by retrofitting the release agent application apparatus 105 to fit the finishing equipment or retrofitting the finishing equipment to accommodate the release agent application apparatus 105, or by using a free-standing release agent application apparatus 105 to condition a substrate with release agent and protect any finishing equipment from ink offset. For example, whether free-standing, or retrofitted, the release agent application apparatus 105 may be attached to, or placed in front of, the in-feed side of off-line finishing equipment and configured to apply a layer of release agent to a first side 107*a*, a second side 107*b*, or both sides 107*a*, 107*b* of the substrate 107, in this example.

The fresh release agent applied to the substrate 107 immediately before a process performed by any piece of finishing equipment will protect the image from ink offset to any surfaces within the finishing equipment which contact the inked substrate 107. Alternatively, or in addition to placing the release agent application apparatus 105 at the in-feed side of a piece of finishing equipment, the release agent application apparatus 105 may be positioned at the out-feed side of a piece of finishing equipment so that a next piece of finishing equipment may be protected from ink offset.

Accordingly various embodiments, the release agent application apparatus 105 may be configured to apply a release agent to one side of a substrate 107 in the case of a simplex printed substrate 107. In simplex printing, there would only be a need to apply release agent to the printed side of the printed substrate. In other embodiments, the release agent application apparatus 105 may be configured to selectively apply release agent to two sides of a printed substrate in a case of duplex printing which would print an image on two sides of the substrate 107. If configured for duplex printing, a single release agent application apparatus 105 may be configured to treat both the first side 107*a* and the second side 107*b* of the substrate, or more than one release agent application apparatus 105 may be used to apply the release agent to the substrate 107. For example, because there would be a need to apply release agent to both the first side 107*a* and second side 107*b* of the printed substrate 107, a first release agent application apparatus 105 may be provided to treat the first side 107*a*, and a second release agent application apparatus 105 may be inverted and provided to treat the second side 107*b* of the substrate 107 with release agent.

Evidence suggests that the ink offset performance varies greatly depending if the substrate 107 has or has not been freshly treated with release agent. A freshly treated image that is immediately fed into an in-line finishing process is far more robust to ink offset than an image that has been treated at a prior time, allowed to sit (for some time greater than one hour, for example), and then fed back into an off-line finishing process. Accordingly, when residual release agent applied by the print system release agent spreader module 103 carryout is low (i.e., the residual amount of release agent being less than 2 mg/A4 paper size), and the substrate is allowed to sit for a period of time, greater than a day, for example, it is typical for inked areas of the substrate 107 to cause a severe amount of ink offset to, for example, a stationary baffle in various types of finishing equipment. But, when the residual release agent applied by the print system release agent spreader module 103 oil carryout is high (i.e., the residual amount of release agent being about 7-8 mg/A4 paper size) there is typically no evidence of ink offset onto finishing equipment over long runs of printing images onto the substrate 107 and finishing the printed product by way of processing the printed substrate 107 through various finishing equipment.

While a print system may be configured to apply a release agent for its own print processing, the residual release agent is an unreliable source of ink offset protection. Additionally, though it may be feasible to cause high oil carryout by increasing the output of release agent applied to the substrate by the print system release agent spreader module 103 to result in higher residual release agent carryout, this would require over applying the release agent to the substrate 107 inside the print system 101 in hopes of causing an overabundance of release agent to remain on the substrate 107 through the print process performed by the print system 101, and then remain on the substrate 107 after the print process is complete. However, such practice is impractical for many reasons. For example, flooding the substrate 107 with release agent by the print system release agent spreader module 103 is expensive because it wastes release agent by applying an overabundance of release agent. Additionally, applying too much release agent during or before the print process may affect image quality because the release agent may saturate the substrate 107, or migrate unevenly across the substrate 107 during the print process which would affect ink/image adhesion and/or absorption.

Therefore, to avoid waste, make applying a release agent a greener step in a print product manufacturing process, and to avoid image quality issues, the release agent application apparatus 105 is configured to apply release agent to the substrate 107 at an opportune time in the print product manufacturing process. That is, before the printed substrate 107 enters any selected piece printing equipment downstream of a printing process that may need protection from ink offset or finishing equipment whether it be a winder, die cutter, buffer, stacker, gluer, etc. or any combination thereof depending where one or more release agent application apparatuses 105 are positioned throughout the print product manufacturing process in relation to any piece of printing and/or finishing equipment.

Additionally, to avoid one or more of waste and oversaturation, the release agent application apparatus 105 is configured to selectively apply one or more controlled amounts of release agent to the substrate 107. For example, in one embodiment, the release agent application apparatus 105 is configured to selectively apply the release agent at an a rate that may be fixed or adjustable depending on the configuration of the release agent application apparatus of 2 mg/A4 paper size A4 to 12 mg/A4 paper size. In another embodiment, the release agent application apparatus 105 is configured to selectively apply the release agent at an a rate that may be fixed or adjustable depending on the configuration of the release agent application apparatus of 4 mg/A4 paper size to 10 mg/A4 paper size. In another embodiment, the release agent application apparatus 105 is configured to selectively apply the release agent at an a rate that may be fixed or adjustable depending on the configuration of the release agent application apparatus of 7 mg/A4 paper size to 8 mg/A4 paper size.

By applying a selected controlled amount of release agent, the release agent application apparatus 105 applies an optimal amount of release agent to the substrate 107 to prevent ink offset to various printing and/or finishing equipment without flooding the substrate with release agent and relying on a residual amount to remain. Additionally, by applying the release agent at the opportune time, such as just as the substrate is about to enter a piece of finishing equipment, any migration effects caused when the release agent moves around the substrate 107 over time are mitigated.

According to various embodiments, the release agent application apparatus 105 may be configured to determine a position of an image on the substrate 107 by way of various sensors or user control to selectively apply the release agent only to portions of the substrate upon which the image is detected. For example, the release agent application apparatus 105 may be configured to determine whether an image is present on any side of a substrate 107. If, for example, the substrate 107 has two sides, the release agent application apparatus 105 may determine that an image is present on a first side 107*a* and not on a second side 107*b* (or the second side 107*b* and not the first side 107*a*), and therefore be caused to only apply release agent to the first side 107*a* (or the second side 107*b* if that side has the image) of the substrate 107 having this image. The release agent application apparatus 105 may be caused to apply a release agent to only the portion, or portions, of the side 107*a*/107*b* of the substrate 107 having the detected image, or the release agent application apparatus 105 may be selectively caused to apply release agent to an entire side of the substrate 107 having the detected image, for example. Alternatively, the release agent application apparatus 105 may be caused to apply release agent to both sides 107*a*/107*b* of the substrate 107 regardless of whether an image is detected on both sides 107*a*/107*b* of the substrate 107. Or, if the substrate 107 is subjected to duplex printing, i.e. printing an image on both the first side and the second side of the substrate 107, the release agent application apparatus 105 may be configured either alone, or in conjunction with one or more other release agent application apparatuses 105, to selectively apply release agent to one or more of both the first side 107*a* and the second side 107*b* of the substrate 107, one or more of selected portions of both the first side and the second side of the substrate 107, one or more of the entire side of both the first side 107*a* and the second side 107*b* of the substrate 107, or any combination thereof. It should be noted that while the above example refers to a substrate 107 having a first side 107*a* and a second side 107*b*, it should be understood that the substrate 107 may have any number of sides upon which an image may be printed, and any number of release agent application apparatus 105 may be used to apply release agent to any number of sides upon which an image may be printed, detected, or even if a certain side of the substrate 107 is unprinted.

According to various embodiments, as discussed above and illustrated in more detail below in FIG. 3, the release agent application apparatus 105 may take many forms. For example, in one embodiment, the release agent application apparatus 105 may be of a nipped roller pair type comprising a hard-roll and a conformable roller. Release agent may be metered to a hard-roller surface and then transferred to the substrate 107 upon passing through the nip formed by the hard-roll and the conformable roller. Metering the release agent to the hard-roll surface can be done by any number of different ways, such as any digital metering unit, RAM-style oiling system, etc. According to various embodiments, the hard-roll may be any of an aluminum drum coated w/an anodize (e.g. "Hardcoat" or "Hardlube") intended to deliver desired surface roughness and durability, ceramic, other metal, plastic, carbon fiber, etc. The conformable roller may be constructed of any type of steel core coated w/polyurethane rubber or any other coating of any material of a given thickness (e.g. 2.5 mm) to enable conformability, or any solid polymer, composite, other metal that is softer than a metal of the hard roll, carbon fiber, or any material or combination of materials such that the conformable roller is configured to deform more than the hard roll under a same pressure.

Alternatively, the rollers that form the nipped roller pair may both be hard-rolls or conformable rollers. As discussed above, the release agent may be metered to the hard-roll surface, but it should be noted that in one or more embodiments, the release agent may be metered to either of the hard-roll surface, the conformable roller, both the hard-roll and the conformable roller to apply release agent to multiple sides of the substrate 107, or both the hard-roll or both the conformable roll if the release agent application apparatus 105 is so configured.

According to various embodiments, the thermal state of the nipped roller pair need not be any hotter than the ambient surroundings. Accordingly, there is no need for either roll to be thermally controlled. The pressure within the nip would only need to be sufficient enough to enable conformance between the hard-roll and the media/ink. But, in other embodiments, any of the rolls in the release agent application apparatus may be heated to enhance a flow rate or spreading of the release agent or cleaning the rollers, and/or the metering unit may be configured to heat the release agent to aid in enhancing the flow rate of or spreading of the release agent, or cleaning, for example.

According to various embodiments, the release agent application apparatus 105, if configured to be a nipped roller pair type, is configured to apply a pressure to the substrate 107 as the substrate 107 passes through the nipped roller pair that is sufficient for spreading the release agent evenly upon application to the selected portions, or over the entire selected surface of the substrate 107. For example, in one embodiment, the pressure may be fixed or variable. The pressure applied by the nipped roller pair type release agent application apparatus 105 is in a range of 0.1 psi to 1500 psi. In another embodiment, the pressure applied by the nipped roller pair type release agent application apparatus 105 is in a range of 100 psi to 1000 psi. In another embodiment, the pressure applied by the nipped roller pair type release agent application apparatus 105 is in a range of 200 psi to 500 psi. The pressure applied may be controlled to be any of the amount within the ranges discussed above, or simply controlled to apply a pressure within a selected or predetermined range, and may be limited to one or more selected portions or an entire surface side of the substrate.

According to various embodiments, alternatively, or in addition to the release agent application apparatus 105 being a nipped roller pair type release agent application apparatus, the release agent application apparatus 105 may be fitted with one or more spray nozzles that may be actuated to selectively apply a release agent to the substrate 107. The amount of release agent may be metered to be any of the amounts discussed above, and may be limited to one or more selected portions or an entire surface side of the substrate, as discussed above.

According to various embodiments, alternatively, or in addition to the release agent application apparatus 105 being a nipped roller pair type release agent application apparatus, and/or the release agent application apparatus 105 being fitted with one or more spray nozzles, the release agent application apparatus 105 may be fitted with one or more belts that are configured to selectively apply a release agent to the substrate 107. The amount of release agent may be metered to be any of the amounts discussed above, and may be limited to one or more selected portions or an entire surface side of the substrate, as discussed above.

According to various embodiments, the release agent application apparatus 105 may be controlled by any means such as by way of integrated switches and/or user interface. Alternatively, or in addition to such controls, any number of release agent application apparatuses 105 may be configured to be controlled by way of a central control unit that is remote from any of the release agent application apparatuses 105 and communicates with one or more of the release agent application apparatuses 105 by any means such as a wired or wireless network, for example. Such control and communication, whether onboard or remote from any number of release agent application apparatuses 105, may be facilitated and/or caused by way of a chipset such as that discussed below in FIG. 8.

Figure 2:
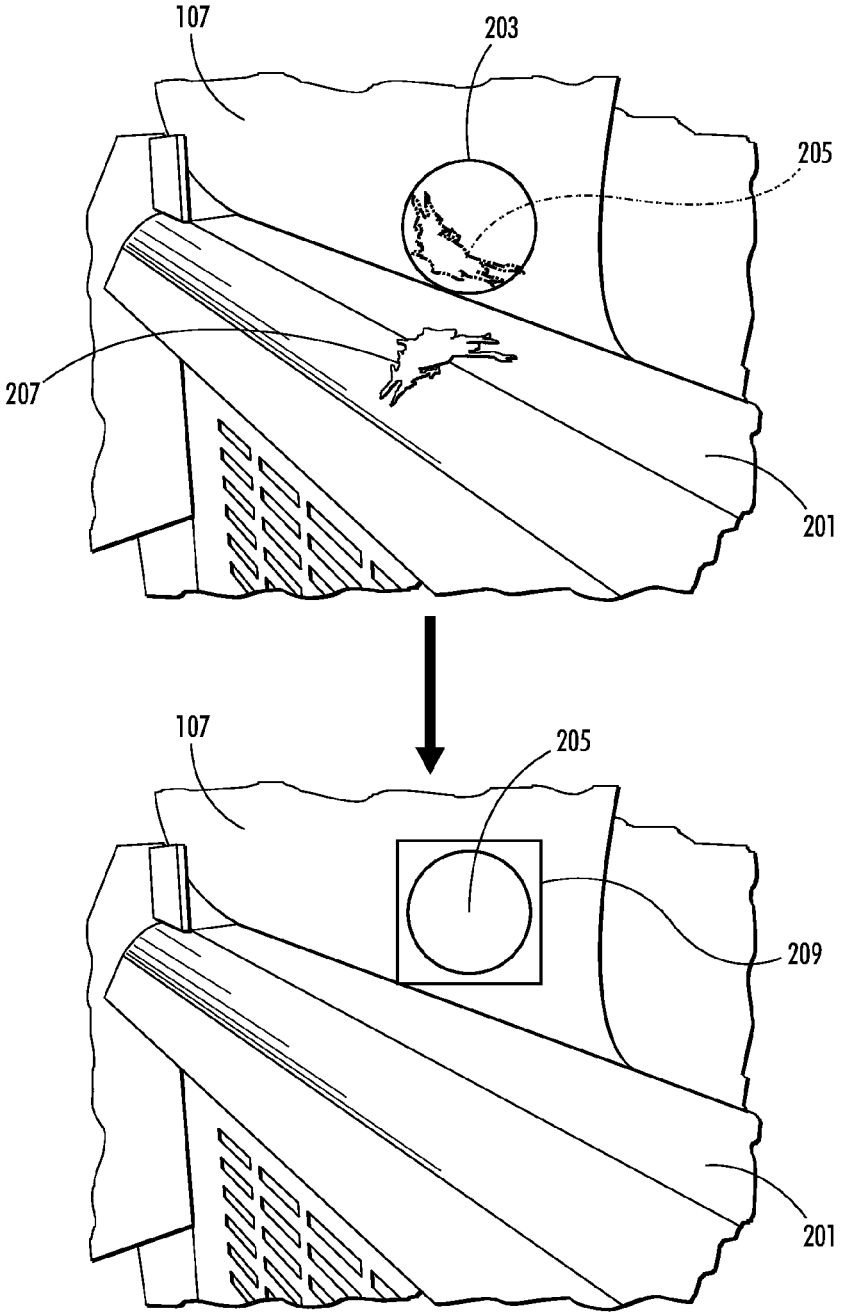
FIG. 2 is a diagram illustrating ink offset, according to one embodiment.

FIG. 2 is a diagram of a comparison of a piece of finishing equipment 201 having a substrate 107 run through it for finishing processing being coated with a sufficient amount of release agent and one not so coated. The substrate 107 has an image 203 printed on one side of the substrate 107. The printed substrate 107 is not coated with any release agent, or is coated with an insufficient amount of release agent, for example, less than 2 mg/A4 paper size, and a portion of the image 205 is left as ink offset 207 on the finishing equipment 201. The ink offset 207 not only causes a mess that requires cleaning and/or potential damage to the finishing equipment, but may also cause image related defects to the image 203. For example, a portion of the image 205 may be lost to the finishing equipment 201 so that the image 203 looks either incomplete, or has an unwanted finish, for example. Additionally, ink offset 207 may be transferred to other substrate 107 portions that pass through the finishing equipment 201. If the ink offset 207 is transferred, it may ruin an image 203 that is printed on a subsequent substrate 107 by causing streaking, ruining a printed finish of the image 203 and/or just covering the image 203 with unwanted ink, for example. Further, ink offset 207 may also be transferred to other portions of the finishing equipment 201 by subsequent substrate 107 portions as it is dragged through the finishing equipment 201.

But, when release agent 209 is applied by the release agent application apparatus 105 discussed above to cover at least the determined portion of the substrate 107 having the image 203, for example at the amounts discussed above such as, but not limited to 7-8 mg/A4 size paper, there is no evidence over long runs of printed product of ink offset 207 to the finishing equipment 201.

Figure 3:
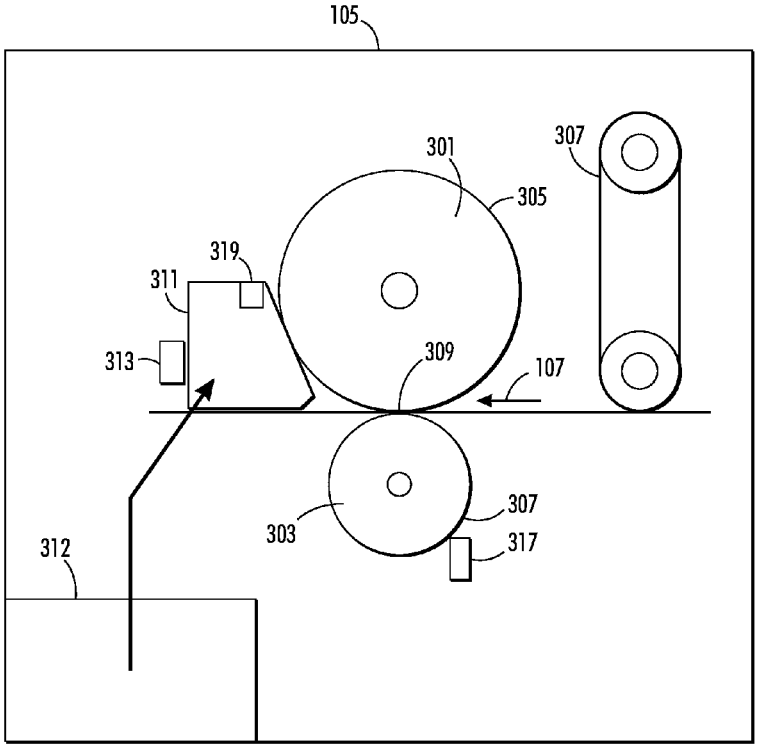
FIG. 3 is a diagram of a release agent application apparatus, according to one embodiment.

FIG. 3 is a diagram of the release agent application apparatus 105. As shown, the release agent application apparatus 105 has a nipped roller pair comprising a hard-roll 301 and a conformable roller 303. Release agent may be metered to a hard-roller surface 305 and then transferred to the substrate 107 upon passing through the nip 309 formed by the hard-roll 301 and the conformable roller 303. Metering the release agent to the hard-roll surface can be done by any number of different ways, such as any metering unit 311 that may be a digital metering unit, RAM-style oiling system, etc.

As discussed above, the hard-roll 301 may be any of an aluminum drum coated w/an anodize (e.g. "Hardcoat" or "Hardlube") intended to deliver desired surface roughness and durability, ceramic, other metal, plastic, carbon fiber, etc. The conformable roller 303 may be constructed of any type of steel core coated w/polyurethane rubber or any other coating of any material of a given thickness (e.g. 2.5 mm) to enable conformability, or any solid polymer, composite, other metal that is softer than a metal of the hard roll, carbon fiber, or any material or combination of materials such that the conformable roller 303 is configured to deform more than the hard roll 301 under a same pressure.

Alternatively, the rollers 301/303 that form the nipped roller pair may both be hard-rolls or conformable rollers. As discussed above, the release agent may be metered to the hard-roll surface 305, but it should be noted that in one or more embodiments, the release agent may be metered to either of the hard-roll surface 305, the conformable roller 303, for example on a conformable roller surface 307, or from an inside of the conformable roller 303 so as to permeate outward for application to the substrate 107, both the hard-roll 301 and the conformable roller 303 to apply release agent to multiple sides of the substrate 107. Alternatively, both the hard-rolls 301 or both the conformable rollers 305 may have release agent metered to them if the release agent application apparatus 105 is so configured. It should be noted that while this example shows only two rollers 301/303 that form the nipped roller pair, the release agent application apparatus 105 may be configured to have any number of rollers of any type or combination of types to form or not form any number of nipped roller pairs. Additionally, the release agent application apparatus 105 may be configured to apply release agent to the substrate 107 in any direction the substrate moves through the release agent application apparatus 105, and the metering unit 311 may be configured to meter release agent to one or both of the rollers 301,303. Alternatively, the release agent application apparatus 105 may be configured to have independent metering units 311 to meter release agent to any respective roller.

If the release agent application apparatus 105 is configured to have multiple independent metering units 311, the release agent application apparatus may, in various embodiments, further be configured to use any of the multiple metering units 311 as backup systems to control the application of release agent to any other roller than its respective roller, for example, in the case of a malfunction. Or, if the metering units 311 are independently sourced by one or more source reservoirs 312, or are sources themselves, for example, the metering units 311 may provide release agent by way of a connector channel, for example, to other metering units 311. The flow of release agent from one metering unit 311 to another metering unit 311 may be controlled to allow release agent to flow from one metering unit 311 to another metering unit 311 by the source metering unit 311, the receiving metering unit 311, or an overall system control unit having a chipset discussed below in FIG. 8 to provide for redundancies and allow for seamless protection of finishing equipment from ink offset in a case of a partial breakdown.

As discussed above, according to various embodiments, alternatively, or in addition to the release agent application apparatus 105 being a nipped roller pair type, the release agent application apparatus 105 may be fitted with one or more spray nozzles 313 that may be actuated to selectively apply a release agent to the substrate 107. The amount of release agent may be metered to be any of the amounts discussed above, and may be limited to one or more selected portions or an entire surface side of the substrate, as discussed above.

According to various embodiments, alternatively, or in addition to the release agent application apparatus 105 being a nipped roller pair type, and/or the release agent application apparatus 105 being fitted with one or more spray nozzles 313, the release agent application apparatus 105 may be fitted with one or more belts 315 that are configured to selectively apply a release agent to the substrate 107. The amount of release agent may be metered to be any of the amounts discussed above, and may be limited to one or more selected portions or an entire surface side of the substrate, as discussed above.

According to various embodiments, the release agent application apparatus 105 may be configured to drive the substrate 107 through it by way of one or more motors 317 that may drive one or more of the hard-roll 301, conformable roller 303, belt 315, etc. for example. Alternatively, or in addition to being driven, the substrate 107 may be drawn through the release agent application apparatus 105 by way of web tension that may be cause by any piece of equipment that is downstream of the release agent application apparatus 105 in a process direction, whether that equipment be finishing equipment or printing equipment, for example.

As discussed above, the release agent may be heated to aid in spreading the release agent and/or cleaning the release agent application apparatus 105. For example, the release agent application apparatus 105 may be outfitted with one or more heat elements 319 that may be integrated into any of the rollers 301, 303, the metering unit 311, or configured to heat the belt 315. Alternatively, or in addition to the heat element 319 being integrated into the any portion of the release agent application apparatus 105, the heat element 319 may preheat any release agent stored in one or more source reservoirs 312.

Figure 4:
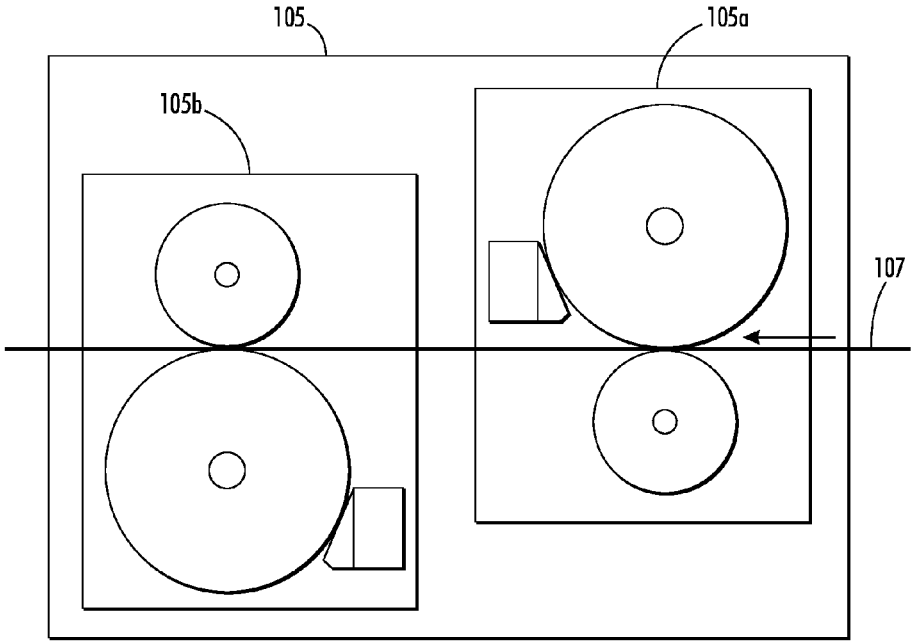
FIG. 4 is a diagram of two release agent application apparatuses set up for duplex printing, according to one embodiment.

FIG. 4 is a diagram of an example configuration of release agent application apparatuses 105*a* and 105*b* to accommodate a duplex printed substrate 107. In this example, the release agent application apparatuses 105*a*/105*b* may not be configured to individually apply application agent to more than one side of the substrate 107. Accordingly, in order to be able to apply release agent to both a first side and a second side of the substrate, a single side release agent application apparatus 105*a* is placed in-line with another inverted single side release agent application apparatus 105*b*. This arrangement may be internal to an overall application apparatus 105 that comprises both the release agent application apparatus 105*a* and inverted release agent application apparatus 105*b*, or by two separate release agent application apparatuses 105 that are predisposed to apply release agent to a specific side of the substrate 107, or retrofitted to accomplish this task.

Figure 5:
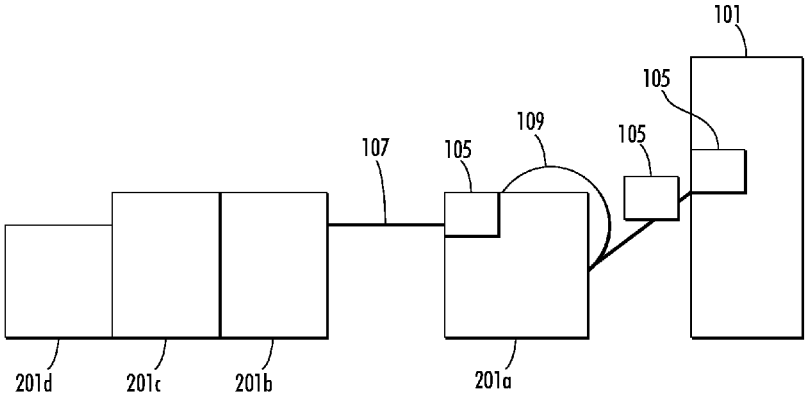
FIG. 5 is a diagram of downstream finishing equipment and placement of one or more release agent application apparatuses, according to one embodiment.

FIG. 5 is a diagram of optional placement of the release agent application apparatus 105. Any number of release agent apparatuses 105 may be placed at any position along a print product manufacturing process. For example, the release agent application apparatus 105 may be mounted directly to the print system 101, be positioned as a standalone release agent application apparatus 105 between the print system 101 and a winder and/or unwinder illustrated as 201*a* that may be part of the print system 101 or may be one or more separate pieces of finishing equipment 201, mounted directly to a winder/unwinder 201*a*, or as a standalone release agent application apparatus 105 between the winder/unwinder 201*a* and another other piece of finishing equipment 201*b*, 201*c*, 201*d*, for example. For this example, finishing equipment 201*b* is a buffer, 201*c* is a cutter, and 201*d* is a stacker. It should be noted that while the finishing equipment 201*a*, 201*b*, 201*c* and 201*d* are illustrated, any number of pieces of finishing equipment 201 may be available to be used and/or protected during a print product manufacturing process.

The winder/unwinder 201*a*, though illustrated as a single entity, may be a single entity, or it may be two separate pieces of finishing equipment 201 and may, for example be operated at separate times if the roll 109 is removed and stored for some time before finishing when then the roll 109 is to be unwound by the unwinder 201*a*. If mounted to the winder/unwinder 201*a*, the release agent application apparatus 105 may be mounted at a position such that it is before the substrate comes in contact with any surfaces of the winder/unwinder 201, for example to protect surfaces of the winder/unwinder 201*a*. Alternatively, or in addition to such placement, the release agent application apparatus 105 may be mounted to an output end of the unwinder 201*a*, for example, to apply release agent before the substrate 107 is fed to any other finishing equipment 201*b*, 201*c*, and 201*d* downstream of the winder/unwinder 201*a* in the print product manufacturing process, for example.

Alternatively, the print system 101 may be configured to accommodate sheets of substrate 107, or cut the a rolled substrate 107 into sheets to that the substrate 107 is stacked at an output side of the print system 101. Accordingly, the winder/unwinder 201*a* may be replaced by a stacker which may also be fitted accordingly with a release agent application apparatus 105.

Figure 6:
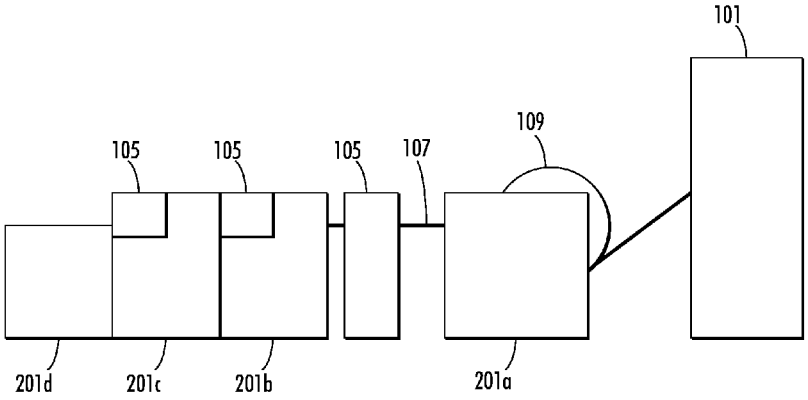
FIG. 6 is a diagram of downstream finishing equipment and placement of one or more release agent application apparatuses, according to one embodiment.

FIG. 6 is a diagram of other alternative placement of one or more release agent application apparatuses 105. As discussed above, the release agent application apparatus 105 may take many forms such as a standalone apparatus and may, in some embodiments, be adaptable to be retrofitted to any piece of finishing equipment 201. If, for example, the winder/unwinder 201*a* is such that mounting the release agent application apparatus 105 is prohibitive from an integration or cost standpoint, one or more release agent application apparatuses 105 may be mounted to any of the other finishing equipment 201*b*, 201*c*, and 201*d*, or positioned as a standalone apparatus after the winder/unwinder 201*a* but before, or between, any of the other finishing equipment 201 which may or may not be connected in-line as illustrated and may have spacing and/or timing between operations between them. This configuration, however, does not protect the winder/unwinder 201*a* components from risk of ink offset. Both concepts are however far better than doing nothing to mitigate ink offset for off-line finishing. For this example, finishing equipment 201*b* is a buffer, 201*c* is a cutter, and 201*d* is a stacker. It should be noted that while the finishing equipment 201*a*, 201*b*, 201*c* and 201*d* are illustrated, any number of pieces of finishing equipment 201 may be available to be user and/or protected during a print product manufacturing process.

Figure 7:
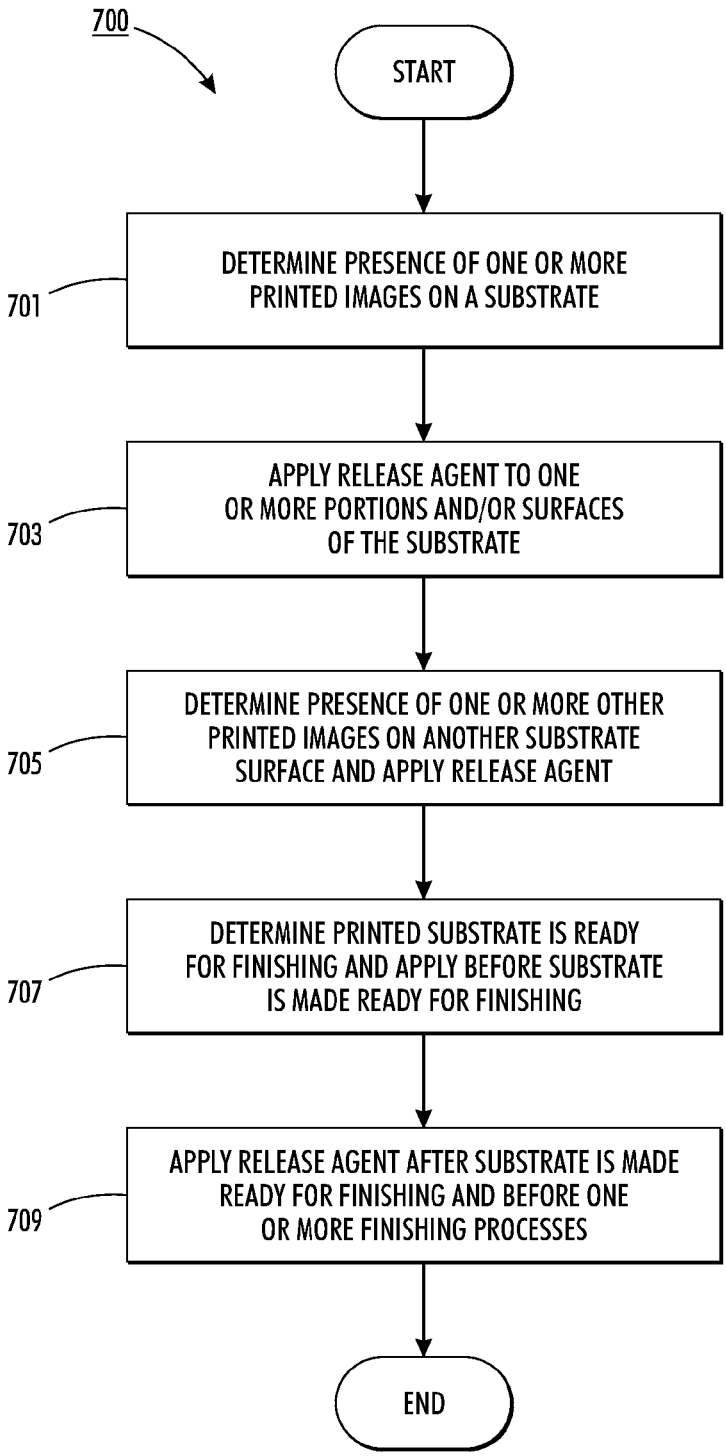
FIG. 7 is a flowchart of a process for applying a release agent to a substrate to prevent ink offset from the substrate to one or more portions of print processing and/or finishing equipment, according to one embodiment.
Figure 8:
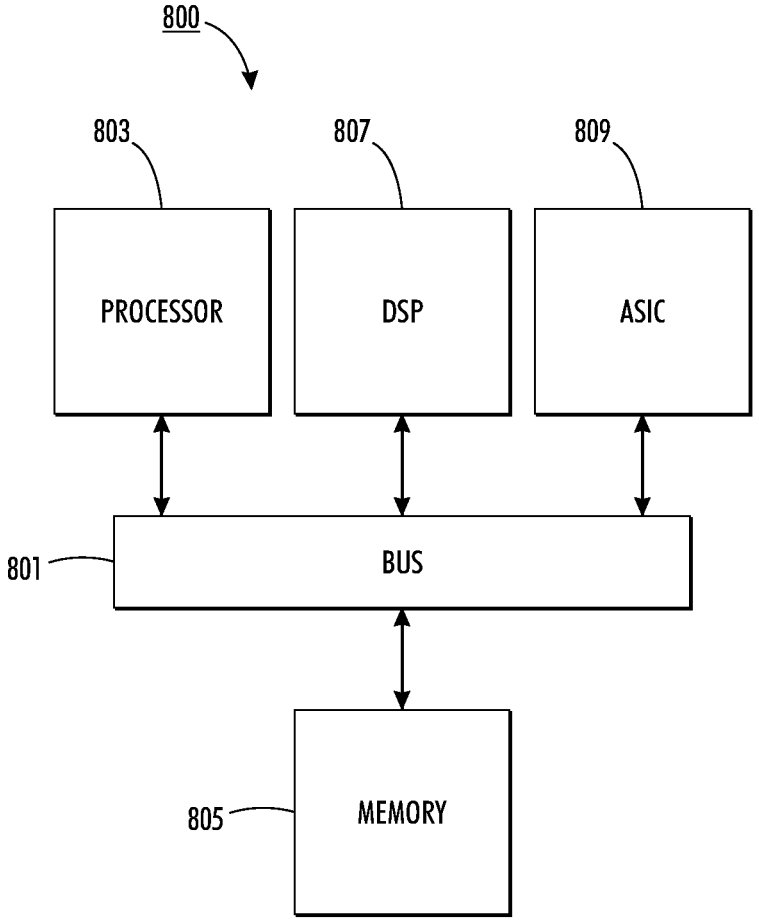
FIG. 8 is a diagram of a chip set that can be used to implement an embodiment.

FIG. 7 is a flowchart of a process for applying a release agent to a substrate to prevent ink offset from the substrate to one or more portions of print processing and/or finishing equipment, according to one embodiment. In one embodiment, the release agent application apparatus 105 is caused to perform the process 700 by way of computer readable code implemented in, for instance, a chip set including a processor and a memory as shown in FIG. 8. Alternatively, the process may be performed by any user that is implementing any release agent application apparatuses 105 at any position in a print product manufacturing process. In step 701, a presence of at least one ink image 203 applied to at least one portion of at least one of a first surface and a second surface of the substrate 107 by way of at least one step of a printing process is determined. The process continues to step 703 in which the release agent application apparatus 105 is caused, at least in part, to apply the release agent to the substrate 107 so as to cover the at least one portion of at least one of the first surface and the second surface of the substrate 107 upon which the at least one ink image 203 is applied. According to various embodiments, the release agent may be applied following a completion of any step of the printing process, or after a determination that the printing process is itself complete. In one or more embodiments, the release agent may be applied to selective portions of the substrate 107, for example, those portions having the inked image 203, or any other selected portions. Alternatively, the release agent may be applied to an entirety of at least the selected first surface or second surface. But, in one or more embodiments, the release agent may caused to be applied to both the first surface and the second surface of the substrate 107, and possibly to any other surface of the substrate 107 if there are more than two surfaces.

For example, in step 705, a user may determine or the release agent application apparatus 105 may be caused to determine a presence of at least one other ink image applied by way of at least one other step of the printing process to at least one portion of the other of the first surface and the second surface of the substrate, for example in a case of duplex printing. The other image may be applied at the same time as the first image, but it may be also applied at a different time in the printing process. If the release agent application apparatus was not already caused to apply a release agent to both sides of the substrate 107, the release agent application apparatus may optionally be caused to apply the release agent to the substrate so as to cover both the at least one portion of at least one of the first surface and the second surface of the substrate 107 upon which the at least one ink image is applied and the at least one portion of the other of the first surface and the second surface of the substrate 107 upon which the at least one other ink image is applied.

Then, in step 707, a determination is made as to whether the substrate is to be made ready for finishing by at least one of rolling and stacking the substrate 107 after completion of the printing process. Then, the release agent application apparatus, if so positioned, causes, at least in part, the release agent to be applied at a time before the substrate is made ready for finishing.

Next, the process continues to step 709 in which, if the release agent application apparatus 105 is so positioned, the release agent application apparatus 105 is caused, at least in part, to apply the release agent at a time after the substrate 107 is made ready for finishing and before one or more times associated with one or more respective occurrences of one or more finishing steps, for example, die cutting, stacking, unwinding, etc.

As discussed above, the release agent application apparatus 105 may be any type such as, but not limited to, a nipped roller pair type, a spray nozzle type, a belt applicator type, or any combination thereof. Additionally, when the release agent application apparatus 105 is caused to apply the release agent to the substrate 107, it may do so a rate of 2 mg/A4 paper size to 12 mg/A4 paper size. In another embodiment, the release agent may be applied at a rate of 4 mg/A4 paper size to 10 mg/A4 paper size. In still another embodiment, the release agent may be applied at a rate of 7 mg/A4 paper size to 8 mg/A4 paper size. The release agent application apparatus 105, as discussed above, may be configured to control an amount of release agent that is applied within the above example ranges, or it may be configured to simply apply an amount that just falls within the above example ranges, whether that particular range is selectable or not selectable, without specificity.

The processes described herein for applying a release agent to a substrate to prevent ink offset from the substrate to one or more portions of print processing and/or finishing equipment may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 8 illustrates a chip set or chip 800 upon which an embodiment may be implemented. Chip set 800 is programmed to apply a release agent to a substrate to prevent ink offset from the substrate to one or more portions of print processing and/or finishing equipment as described herein may include, for example, bus 801, processor 803, memory 805, DSP 807 and ASIC 809 components.

The processor 803 and memory 805 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 800 can be implemented in a single chip. It is further contemplated that in certain embodiments the chip set or chip 800 can be implemented as a single "system on a chip." It is further contemplated that in certain embodiments a separate ASIC would not be used, for example, and that all relevant functions as disclosed herein would be performed by a processor or processors. Chip set or chip 800, or a portion thereof, constitutes a means for performing one or more steps of applying a release agent to a substrate to prevent ink offset from the substrate to one or more portions of print processing and/or finishing equipment.

In one or more embodiments, the chip set or chip 800 includes a communication mechanism such as bus 801 for passing information among the components of the chip set 800. Processor 803 has connectivity to the bus 801 to execute instructions and process information stored in, for example, a memory 805. The processor 803 may include one or more processing cores with each core configured to perform independently. A multi-core processor enables multiprocessing within a single physical package. Examples of a multi-core processor include two, four, eight, or greater numbers of processing cores. Alternatively or in addition, the processor 803 may include one or more microprocessors configured in tandem via the bus 801 to enable independent execution of instructions, pipelining, and multithreading. The processor 803 may also be accompanied with one or more specialized components to perform certain processing functions and tasks such as one or more digital signal processors (DSP) 807, or one or more application-specific integrated circuits (ASIC) 809. A DSP 807 typically is configured to process real-world signals (e.g., sound) in real time independently of the processor 803. Similarly, an ASIC 809 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 803 performs a set of operations on information as specified by computer program code related to applying a release agent to a substrate to prevent ink offset from the substrate to one or more portions of print processing and/or finishing equipment. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 801 and placing information on the bus 801. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 803, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 803 and accompanying components have connectivity to the memory 805 via the bus 801. The memory 805 may include one or more of dynamic memory (e.g., RAM, magnetic disk, writable optical disk, etc.) and static memory (e.g., ROM, CD-ROM, etc.) for storing executable instructions that when executed perform the inventive steps described herein to apply a release agent to a substrate to prevent ink offset from the substrate to one or more portions of print processing and/or finishing equipment. The memory 805 also stores the data associated with or generated by the execution of the inventive steps.

In one or more embodiments, the memory 805, such as a random access memory (RAM) or any other dynamic storage device, stores information including processor instructions for applying a release agent to a substrate to prevent ink offset from the substrate to one or more portions of print processing and/or finishing equipment. Dynamic memory allows information stored therein to be changed by system 100. RAM allows a unit of information stored at a location called a memory address to be stored and retrieved independently of information at neighboring addresses. The memory 805 is also used by the processor 803 to store temporary values during execution of processor instructions. The memory 805 may also be a read only memory (ROM) or any other static storage device coupled to the bus 801 for storing static information, including instructions, that is not changed by the system 100. Some memory is composed of volatile storage that loses the information stored thereon when power is lost. The memory 805 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 803, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for applying a release agent to a substrate having at least a first surface and a second surface, the method comprising:

receiving the substrate downstream from the ink printing apparatus, the ink printing apparatus configured to apply the at least one ink image to the substrate;

determining a presence of at least one ink image applied to at least one portion of at least one of the first surface and the second surface of the substrate by way of at least one step of a printing process; and causing the release agent to be applied to the substrate so as to cover the at least one portion of at least one of the first surface and the second surface of the substrate upon which the at least one ink image is applied to prevent ink offset therefrom.

2. The method of claim 1, further comprising:

causing the release agent to be applied at a time after completion of the at least one step of the printing process, the completion of the at least one step of the printing process occurring after the ink image is bonded to the substrate.

3. The method of claim 2, further comprising:

determining the printing process is completed; and causing the release agent to be applied based on the determined completion of the printing process.

4. The method of claim 1, further comprising:

causing the release agent to be applied to cover an entirety of at least one of the first surface and the second surface of the substrate upon which the at least one ink image is applied.

5. The method of claim 4, further comprising:

determining a selection to cause the release agent to be applied to the entirety of at least one of the first surface and the second surface of the substrate.

6. The method of claim 4, further comprising:

causing the release agent to be applied to both the first surface and the second surface of the substrate.

7. The method of claim 1, further comprising:

determining a presence of at least one other ink image applied by way of at least one other step of the printing process to at least one portion of the other of the first surface and the second surface of the substrate; and causing the release agent to be applied to the substrate so as to cover both the at least one portion of at least one of the first surface and the second surface of the substrate upon which the at least one ink image is applied and the at least one portion of the other of the first surface and the second surface of the substrate upon which the at least one other ink image is applied.

8. The method of claim 1, further comprising:

determining the substrate is to be made ready for finishing by at least one of rolling and stacking the substrate after completion of the printing process; and causing the release agent to be applied on the at least one ink image at a time before the substrate is made ready for finishing.

9. The method of claim 8, further comprising:

causing the release agent the be applied at a time after the substrate is made ready for finishing and before one or more times associated with one or more respective occurrences of one or more finishing steps.

10. The method of claim 1, further comprising:

causing the substrate to be made ready for finishing by at least one of rolling and stacking the substrate after completion of the printing process; and causing the release agent to be applied on the at least one ink image at a time after the substrate is made ready for finishing and before one or more times associated with one or more respective occurrences of one or more finishing steps.

11. The method of claim 1, wherein the release agent is applied at a rate of 2 mg/A4 paper size to 12 mg/A4 paper size.

12. The method of claim 1, wherein the release agent is applied by one or more release agent application apparatuses comprising one or more rollers that are configured to apply the release agent.

13. The method of claim 12, wherein the release agent application apparatus comprises two or more rollers that form a nipped roller pair, the release agent is applied by at least one roller of the nipper roller pair, and the nipped roller pair causes a pressure to be exerted on the substrate to spread the release agent.

14. The method of claim 1, wherein the release agent is applied by one or more release agent application apparatuses comprising one or more spray nozzles configured to apply the release agent.

15. The method of claim 1, wherein the release agent is applied by one or more release agent application apparatuses comprising at least one belt configured to apply the release agent.

16. An apparatus for applying a release agent to a substrate having at least a first surface and a second surface, the apparatus comprising:

at least one processor; and at least one memory including computer program code for one or more programs, the at least one memory and the computer program code configured to, with the at least one processor, cause the apparatus to perform at least the following, receiving the substrate downstream from the ink printing apparatus, the ink printing apparatus configured to apply the at least one ink image to the substrate;

determining a presence of the at least one ink image applied to at least one portion of at least one of the first surface and the second surface of the substrate by way of at least one step of a printing process; and causing the release agent to be applied to the substrate so as to cover the at least one portion of at least one of the first surface and the second surface of the substrate upon which the at least one ink image is applied to prevent ink offset therefrom.

17. The apparatus of claim 16, wherein the apparatus is further caused to:

cause the release agent to be applied at a time after completion of the at least one step of the printing process, the completion of the at least one step of the printing process occurring after the ink image is bonded to the substrate.

18. The apparatus of claim 17, wherein the apparatus is further caused to:

determine the printing process is completed; and cause the release agent to be applied based on the determined completion of the printing process.

19. The apparatus of claim 16, wherein the apparatus is further caused to:

cause the release agent to be applied to cover an entirety of at least one of the first surface and the second surface of the substrate upon which the at least one ink image is applied.

20. The apparatus of claim 19, wherein the apparatus is further caused to:

determine a selection to cause the release agent to be applied to the entirety of at least one of the first surface and the second surface of the substrate.

21. The apparatus of claim 19, wherein the apparatus is further caused to:

cause the release agent to be applied to both the first surface and the second surface of the substrate.

22. The apparatus of claim 16, wherein the apparatus is further caused to:

determine a presence of at least one other ink image applied by way of at least one other step of the printing process to at least one portion of the other of the first surface and the second surface of the substrate; and cause the release agent to be applied to the substrate so as to cover both the at least one portion of at least one of the first surface and the second surface of the substrate upon which the at least one ink image is applied and the at least one portion of the other of the first surface and the second surface of the substrate upon which the at least one other ink image is applied.

23. The apparatus of claim 16, wherein the apparatus is further caused to:

cause the substrate to be made ready for finishing by at least one of rolling and stacking the substrate after completion of the printing process; and cause the release agent to be applied on the at least one ink image at a time before the substrate is made ready for finishing.

24. The apparatus of claim 23, wherein the apparatus is further caused to:

cause the release agent the be applied at a time after the substrate is made ready for finishing and before one or more times associated with one or more respective occurrences of one or more finishing steps.

25. The apparatus of claim 16, wherein the apparatus is further caused to:

cause the substrate to be made ready for finishing by at least one of rolling and stacking the substrate after completion of the printing process; and cause the release agent to be applied on the at least one ink image at a time after the substrate is made ready for finishing and before one or more times associated with one or more respective occurrences of one or more finishing steps.

26. The apparatus of claim 16, wherein the release agent is applied at a rate of 2 mg/A4 paper size to 12 mg/A4 paper size.

27. The apparatus of claim 16, further comprising:

one or more rollers that are configured to apply the release agent.

28. The apparatus of claim 27, further comprising:

two or more rollers that form a nipped roller pair, wherein the release agent is applied by at least one roller of the nipper roller pair, and the nipped roller pair causes a pressure to be exerted on the substrate to spread the release agent.

29. The apparatus of claim 16, furthering comprising:

one or more spray nozzles configured to apply the release agent.

30. The apparatus of claim 16, further comprising:

at least one belt configured to apply the release agent.

* * * * *